US005610638A

United States Patent [19]

Courtney

[11] Patent Number: 5,610,638

[45] Date of Patent: Mar. 11, 1997

[54] TEMPERATURE SENSITIVE PRINT MODE SELECTION

[75] Inventor: Thomas P. Courtney, Fairport, N.Y.

[73] Assignee: Xerox Corporation, Stamford, Conn.

[21] Appl. No.: 367,614

[22] Filed: Jan. 3, 1995

[51] Int. Cl.[6] ..... B41J 29/38

[52] U.S. Cl. ..... 347/14; 347/17

[58] Field of Search ..... 347/7, 14, 15, 347/17, 37, 41, 40, 43

[56] References Cited

U.S. PATENT DOCUMENTS

| | | | |
|---|---|---|---|
| 4,653,940 | 3/1987 | Katsukawa | 400/124.03 |
| 4,686,538 | 8/1987 | Kouzato | 347/15 |
| 4,748,453 | 5/1988 | Lin et al. | 347/41 |
| 5,166,699 | 11/1992 | Yano et al. | 347/17 |
| 5,172,142 | 12/1992 | Watanabe et al. | 347/14 |
| 5,237,344 | 8/1993 | Tasaki et al. | 347/9 |
| 5,300,968 | 4/1994 | Hawkins | 347/14 |
| 5,477,246 | 12/1995 | Hirabayashi et al. | 347/17 |
| 5,500,661 | 3/1996 | Matsubara et al. | 347/41 |

*Primary Examiner*—Benjamin R. Fuller
*Assistant Examiner*—L. Anderson
*Attorney, Agent, or Firm*—Oliff & Berridge

[57] ABSTRACT

The printing of an image by a thermal ink jet printer is controlled based on an internal temperature of the printer adjacent the printhead and the density of the printed image. Prior to printing, the temperature of the printhead is estimated, and the density of the image is determined from stored print data. Based on the temperature and density, either a single-pass 100% coverage print mode or a double-pass checkerboard print mode is selected. Also based on the temperature and density, the printhead droplet ejection rate is set. Such control provides a printed image with high quality and prevents misfiring of the ink jets when temperatures and density are high.

40 Claims, 2 Drawing Sheets

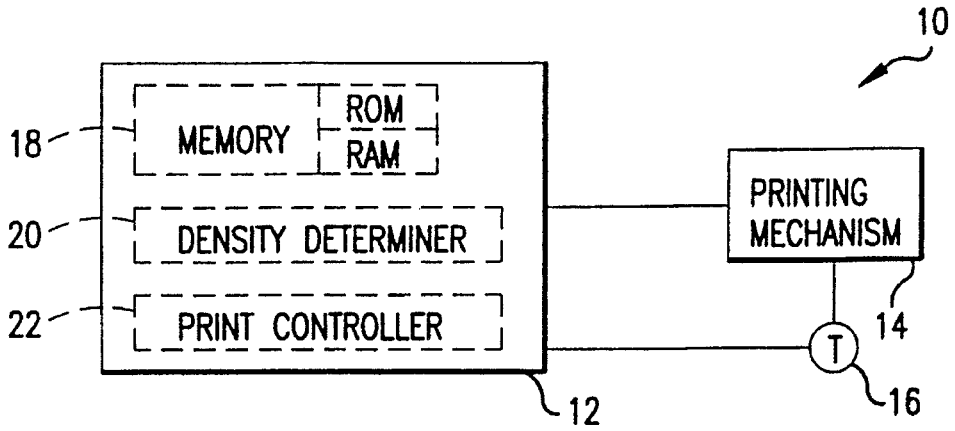
FIG.1
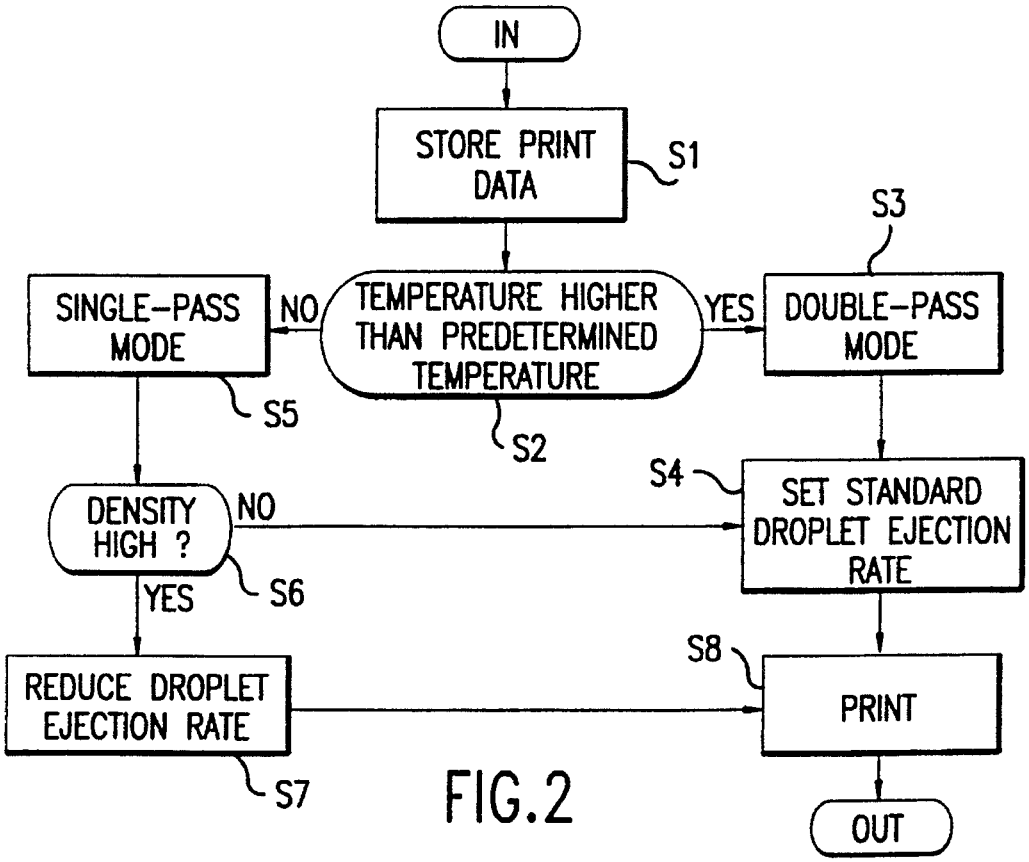
FIG.2
| | ≤30°C | >30°C |
|---|---|---|
| LOW DENSITY | 6KHz 100% | 6KHz CHECKERBOARD |
| HIGH DENSITY | 4.5KHz 100% | 6KHz CHECKERBOARD |
FIG.3

TEMPERATURE SENSITIVE PRINT MODE SELECTION

BACKGROUND OF THE INVENTION

1. Object of the Invention

This invention relates to liquid ink recording devices. In particular, this invention relates to controlling the print mode of thermal ink jet printing device based on temperature of the printhead and density of the printed image.

2. Description of Related Art

In liquid ink recording apparatuses, an image is formed on a substrate by depositing wet ink on the substrate in a predetermined pattern. One type of liquid ink printing apparatus is a thermal ink jet printer, which utilizes a printhead having a plurality of aligned nozzles that eject ink droplets onto the recording medium. Thermal ink jet devices are designed to give the optimum ink dot size at room temperature. However, as the ambient temperature increases, the ink dot size begins to grow causing adjacent ink drops to overlap. Overlapping of still wet ink dots causes image degradation problems such as bleeding and misting and creates an image that is excessively bold. Further, at higher temperatures, the ink jets tend to ingest air that causes intermittent firing of the jets, which also affects the quality of the image In particular, misfiring leads to a grainy appearance of the image within the solid fill regions. Therefore, it is desirable to maintain a constant drop size by reducing the ink drop size at elevated temperatures to obtain a clear and accurate image.

One method for reducing the drop size is to operate the ink jet printhead in a checkerboard printing mode that utilizes two passes of the printhead while ejecting the required dots in an alternating pattern for each swath of printing. Under this mode for example, when printing left to right, the jets fire in an alternating odd, even, odd etc. pattern and, when printing right to left, the jets fire in an alternating even, odd, even etc. pattern, thus firing every other jet for each pass of the printhead across the printing medium. The benefits to using the checkerboard printing include allowing an ink jet twice as long to refill since each jet is only required to fire at every other dot column. Also, firing every other ink jet in this manner cuts the ink supply demand through the cartridge in half. The additional refill time and reduced ink supply demand reduces misfirings. Further, since diagonally adjacent pixel areas are deposited in the same pass, there is no overlap of ink dots from adjacent pixel areas when the ink is still flowable. This prevents the dots from blurring. An example of checkerboard dot deposition for liquid ink printing is disclosed in U.S. Pat. No. 4,748,453 to Lin et al., which employs a checkerboard printing mode based on the printing medium to prevent blurring of the image when printed on the substrate having poor ink absorptive properties.

Another reason for choosing a checkerboard printing mode is when the density of the printed image is high thus requiring the deposition of numerous closely spaced dots, which can result in blurring. An example of using the Checkerboard printing mode based on image density is discussed in U.S. Pat. No. 5,237,344 to Tasaki et al. To more accurately predict when the use of checkerboard printing mode is appropriate, both the density of the image and the estimated temperature of the printhead is used in U.S. Pat. No. 4,653,940 to Katsukawa.

Another means for controlling drop size in a liquid ink recording apparatus is to vary the frequency at which the ink droplets are deposited on the substrate. In an ink jet printhead, the frequency can be varied by reducing the ejection frequency of each ink droplet from the printhead or by lowering the scanning speed of the recording head. Several devices that vary the frequency of the ejection of droplets when temperatures are elevated are disclosed in U.S. Pat. No. 5,300,968 to Hawkins, U.S. Pat. No. 5,172,142 to Watanabe et al., and U.S. Pat. No. 5,166,699 to Yano et al.

However, the above solutions to controlling the dot size require complicated and expensive methods to select the appropriate printing mode. None account for both the actual temperature of the printhead and the density simply and inexpensively. For example, several of the above methods controlling dot size involve selecting the printing mode based on the substrate composition or based on certain environmental conditions, such as estimated temperature or humidity. Other methods that control the frequency of the droplet ejection rate are based solely on the density of the printed image and do not account for the problems caused by elevated temperatures. Therefore, there is a need to simply and inexpensively control the dot size to maintain a high quality printed image.

SUMMARY OF THE INVENTION

An object of this invention is to simply and inexpensively control the ink dot size during the formation of an image.

Another object of this invention is to ensure a high quality and accurate reproduction of an image.

An additional object of this invention is to control dot size at elevated temperatures of a printer and at different image densities.

The embodiments of this invention accomplish these objectives by providing a method of controlling printing of an image with an ink jet printer based on stored data of the image. The method comprises the steps of sensing an internal temperature of the ink jet printer, determining density of the stored image to be printed, and selecting a printing mode from one of a single pass 100% coverage printing mode and a double pass checkerboard printing mode based on the sensed temperature and the determined density.

The objectives of this invention are also accomplished by the embodiments herein that provide a method of printing an image based on image data using an ink jet printhead that comprises the steps of sensing an internal temperature of the printhead, determining density of the image, automatically setting the printhead droplet ejection rate based on the sensed temperature and the determined density, and printing the image using the set ejection rate.

This invention also accomplishes the above objectives with an ink jet printer having a printhead and comprising a memory that stores print data corresponding to an image to be printed, a temperature sensor that senses an internal temperature of the printer adjacent the printhead, and a density determiner that determines density of the image to be printed from the stored print data. A controller, coupled to the memory, the temperature sensor, and the density determiner, automatically selects one of a single pass print mode and a double pass print mode and automatically sets a printhead droplet ejection rate based on the sensed temperature and the determined density. A printing mechanism is coupled to the controller that prints the image based on the stored print data in the selected print mode and the set printhead droplet ejection rate.

Using the methods and device of this invention, ink dot size can be controlled by switching print modes based on ambient temperature. The print mode can be varied by changing the printing frequency or by using checkerboard printing. When the temperature rises above a predetermined temperature, checkerboard printing mode is selected. Also, when a high density image is to be printed at or below the predetermined temperature, the droplet ejection rate is reduced. Thus, ink throughput is reduced for elevated temperatures and for printing high density images merely by changing printing modes, which requires no additional complexity and cost to the device.

Other objects, advantages and salient features of the invention will become apparent from the following detailed description, which taken in conjunction with the annexed drawings discloses preferred embodiments of the invention.

BRIEF DESCRIPTION OF THE DRAWINGS

Referring to the drawings that form a part of this original disclosure:

FIG. 1 is a schematic view of the primary elements of a printer employing this invention;

FIG. 2 is a flowchart depicting the method of selecting the printing mode according to this invention;

FIG. 3 is a table showing examples of selected printing frequency and printing modes at different densities and temperatures;

DETAILED DESCRIPTION OF PREFERRED EMBODIMENTS

Figure 4A:
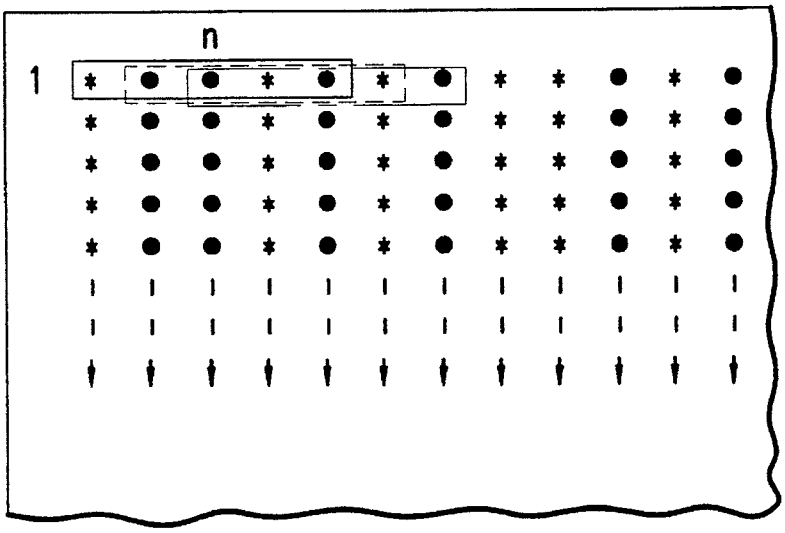
FIGS. 4A and 4B graphically depict an array of print data according to a first embodiment for determining image density.

This invention is described as applied in the thermal ink jet printer having a printhead. However, this invention may be employed in other printing applications, such as plotters or facsimile machines.

FIG. 1 shows the primary components of a printing apparatus 10 that includes a central processing unit (CPU) 12, a printing mechanism 14, and a temperature sensor 16. CPU 12 includes a memory 18, a density determiner 20, and a print controller 22. CPU 12 is a microprocessor or similar processing apparatus. CPU 12 also includes standard known printer control systems and includes an interface for the operation panel. CPU 12 controls various motors such as the sheet feeding motor and the carriage driving motor. Memory 18 stores print data for an image to be printed and includes a ROM memory for storing control programs and various data and a RAM memory for temporarily storing various data such as the print data of the image to be printed. Preferably, the print data is stored in an array of ON and OFF pixels. Density determiner 20 is designed to determine the density of the image to be printed from the stored print data in memory 18 as discussed in detail below. Print controller 22 controls printing mechanism 14 based on the determined density and the temperature sensed by temperature sensor 16.

Printing mechanism 14 is preferably a thermal ink jet printhead having a plurality of aligned nozzles each activated by a resistor in a conventional manner that causes an ink droplet to be ejected from the nozzle. The printhead is supported by a carriage and oriented to face the printing medium. The carriage and supported printhead traverse the printing medium with the nozzles ejecting ink droplets or dots as directed by the print controller. Each pass of the printhead prints a pattern of dots known as a swath. Each swath, which represents one pass of the ink jet printhead, includes a plurality of rasters, which represent one ink jet moving across the swath. In the preferred embodiment of this invention, the printhead is configured to have 128 vertically aligned ink jets, which results in 128 rasters per swath.

Temperature sensor 16 is provided to measure the temperature inside the printer, specifically the temperature in the vicinity of the printhead. Any known temperature sensor can be used. The purpose of temperature sensor 16 is to inexpensively determine an estimate of the printhead temperature. Measuring the printhead temperature directly adds additional costs such as additional printed circuit boards (PCB) on the carriage assembly, additional wire in the carriage ribbon cable, and additional connector lead at the carriage and at the main logic board PCB. The inventor has found that simply measuring the ambient air temperature from a thermistor mounted directly to the main PCB will yield a reasonable estimate of the printhead temperature once a correction factor is subtracted from the thermistor. For example, if the correction factor was 7° C. and the thermistor measured 37° C., the estimate for the printhead temperature would be 30° C.

In operation according to this invention, temperature sensor 16 senses the temperature adjacent the printhead and selects either a single pass 100% coverage print mode or double pass checkerboard print mode for printing as discussed in detail below. The print mode is determined at the start of each swath. The single pass 100% coverage print mode is a typical normal print mode for an ink jet printer. In the single pass print mode, each swath of printing is printed in one pass. Therefore, all of the intended dots are deposited in a single pass based on the print data from the controller. The double pass checkerboard print mode uses two passes for each swath of printing. For example, when printing left to right, the jets fire in an alternating odd, even, odd etc. pattern based on the print data from the controller across the swath. Then, the printhead direction is reversed from right to left, and the jets fire in an alternating even, odd, even etc. pattern. Thus, adjacent dots are deposited in different passes for each swath thereby preventing adjacent wet dots from smearing and blending together. Checkerboard printing provides each ink jet twice as long to refill since each jet is only required to fire on a single pass. Further, firing every other jet in the checkerboard manner reduces the ink supply demand through the cartridge to one half. Experimental observation of ink jets firing in a checkerboard pattern indicates that such a print mode can "fix" nonfiring jets by allowing them sufficient time to refill and preventing the ingestion of air into the nozzle.

In addition to selecting the print mode based on temperature according to this invention, the density of the image to be printed is determined, and printing is controlled in response to that density. Density may be determined using a variety of methods, such as the basic method of counting pixels in a swath. However, it is preferable that the method of determining the density accounts for clustering of pixels within a swath, which results in areas of high ink concentration. Thus, the image density according to the preferred embodiments of this invention is determined using a method of scanning the image density in blocks and determining the area of concentrated pixels.

FIG. 2 shows a flowchart of the steps used to select the printing mode and ejection rate. As seen in FIG. 2, print data is first stored in step S1. Then using temperature sensor 16, the actual temperature adjacent the printhead is sensed in step S2. If the sensed temperature is higher than a predetermined temperature (in this case, a normal ambient temperature of about 30° C.) a double pass checkerboard mode is selected in step S3. For these higher temperatures, a standard droplet ejection rate is set in step S4. Typically, this rate is 6.0 kHz. Then, printing mechanism 14 is instructed to print from print controller 22 based on the selected printing mode and set droplet ejection rate in step S8. When the sensed temperature is a normal ambient temperature or lower in step S2, the single pass mode is selected in step S5. Then, the density is determined in step S6. If the density is high, the standard droplet ejection rate is set in step S4, and in step S8, the image is printed accordingly. However, if the density is high in step S6, the droplet ejection rate is reduced from the standard rate to a lower rate in step S7. For example, it would be reduced from 6.0 kHz to 4.5 kHz. Then, the image is printed accordingly in step S8. Thus, for high temperature and high density printing, the output of the printhead is reduced to prevent the problems discussed above that degrade image quality.

FIG. 3 shows a chart of typical selections of print mode and ejection rate based on sensed temperature and density. When the temperature sensed is higher than normal ambient temperature of about 30° C., which would normally cause the dot size to grow, a double pass checkerboard print mode is automatically selected to reduce the throughput of ink in the individual ink jets. This change of mode provides a simple and inexpensive solution for printing at elevated temperatures requiring no additional complex hardware and circuitry. When the temperature is normal, about 30° C., or lower, the single pass 100% coverage print mode is selected. Then, based on density, the ejection rate is set. When the density is determined to be low, a standard droplet ejection rate, of 6.0 kHz for example, is selected. This applies to temperatures both above and below normal ambient. When the density is determined to be high and the sensed temperature is greater than a normal ambient temperature, the standard droplet ejection rate is set. However, when the density is determined to be high and the temperature is a normal ambient temperature or lower, the droplet ejection rate is changed from the standard rate to a reduced rate, for example 4.5 kHz.

In the above described embodiment, a threshold temperature of 30° C. is used and a standard droplet ejection rate of 6 kHz is used with a reduced rate of 4.5 kHz. However, other threshold temperatures and other appropriate droplet ejection rates may be employed.

The preferred method for determining the density of the image includes filtering an array of data using successive blocks in the array to determine a maximum number of ON pixels in a block. Basically, image density is dependent on the maximum number of pixels that fill a given two dimensional area within a swath. A swath represents one pass of printhead. Each ink jet within a printhead across a swath produces a raster, which is a line of printed data within a swath.

Figure 4B:
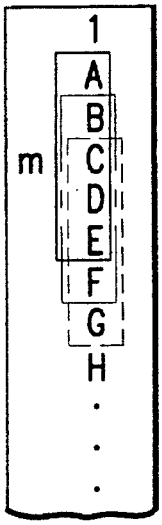

In the first embodiment for determining the image density, a filter analyzes the print data on a raster by raster basis as shown in FIG. 4A. Using the raster by raster filtering method to determine density, first, a window is formed at the upper left edge of an array of print data, which represents the top raster in a swath, as shown in FIG. 4A. According to this embodiment, the window has a size of n×1. n may be any integer, but, for illustrative purposes in this embodiment, n is preferably 48. For purposes of simplicity however, n is shown in FIG. 4A as 5. First, the n×1 window begins at the left edge of the top raster. The number of ON pixels is counted. The window then moves to the right, as shown by the dashed box in FIG. 4A. The window can be moved one pixel as shown or at greater pixel intervals, such as eight pixel intervals. The number of 0N pixels in this window is then counted. The process continues across the array as shown in FIG. 4A until the window reaches the end of the raster. The maximum number of ON pixels found in a window is recorded. The same procedure is used for each of the remaining rasters. For example, in a printhead having 128 vertically aligned ink jets that produces 128 rasters per swath, 128 values representing the maximum fill of any n×1 window within each raster is recorded. These values are stored as a data array as shown in FIG. 4B. For example, in an ink jet having an 128 vertically aligned jets, the data array of maximum numbers would be 1×128.

Next, a second window is formed at the top of the array of maximum numbers. This window has a size of 1×m. Preferably, in this embodiment, m is 48. However, for illustrative purposes, in FIG. 4B, m is shown as 5. The average for all the data within the second window is computed. Then, the 1×m window is moved down the array calculating averages within each window as shown in FIG. 4B. The maximum average value is determined from the set of calculated average values. The maximum average value is a representation of the maximum image density for that swath.

Figure 5:
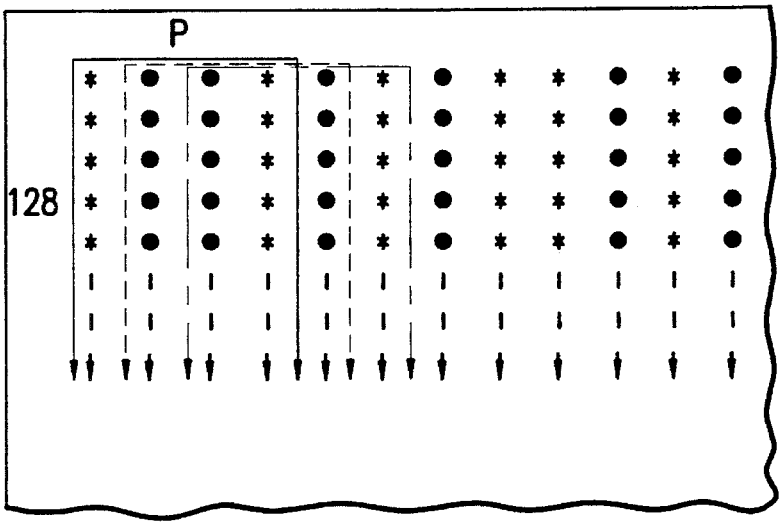
FIG. 5 graphically depicts an array of print data according to the second embodiment for determining image density.

According to a second embodiment of this invention to determine density, the print data is analyzed in a column format, as shown in FIG. 5. In this embodiment, a window is also formed at the top left edge of an array of print data representing a swath. As shown in FIG. 5, this window has the size of p×128, with 128 representing the number of vertically aligned ink jets. The preferred value of p in this embodiment is 48. However, for purposes of illustration, p is shown in FIG. 5 as 4. In operation, if p is too small, it is difficult to discern between double rows of small text versus one row of large text. It is undesirable to make p substantially larger than 48. If p is much larger than 48, it becomes much more difficult to discern between dispersed dot patterns and clustering of dots in a confined region.

Using the second embodiment to determine density, the total number of ON pixels within the window p×128 is counted. The window is then incremented to the right and the total number of ON pixels is counted. Preferably, the window is incremented at eight pixel intervals to decrease the time required to determine density and to correspond to the recorded bits of information. However, to increase resolution, the window can be incremented one pixel at a time. The process continues across the swath until the p×128 window reaches the right edge of the array. The maximum number of ON pixels found in any of the windows is determined. This value is a representation of the maximum density for that swath.

Although the above examples of determining density were described with respect to a conventional data array read from left to right, the method of determining the density can be employed in a data array that is read right to left or from top to bottom and bottom to top.

While advantageous embodiments have been chosen to illustrate the invention, it will be understood by those skilled in the art that various changes and modifications can be made therein without departing from the scope of the invention as defined in the appended claims.

What is claimed is:

1. A method of controlling printing of an image based on stored data of the image by an ink jet printer having a printhead, comprising the steps of:

sensing an internal temperature of the ink jet printer;

determining density of the stored image being printed; and selecting a printing mode from one of a single pass 100% coverage printing mode and a double pass checkerboard printing mode based on the sensed temperature and the determined density.

2. The method of claim 1 further comprising the step of setting a printhead droplet ejection rate based on the sensed temperature and the determined density.

3. The method of claim 1 wherein the step of sensing the temperature comprises sensing a temperature of the printhead.

4. The method of claim 3 wherein sensing the temperature of the printhead comprises measuring an ambient temperature near the printhead.

5. The method of claim 3 wherein sensing the temperature of the printhead comprises measuring a temperature from a circuit board located adjacent the printhead.

6. The method of claim 1 further comprising the step of storing the image data as an array of ON and OFF pixels, and wherein the step of determining the density of the stored image being printed comprises the steps of defining a window that encompasses a block of pixels in the array, positioning the window around successive blocks of pixels in the entire array, counting a number of ON pixels in each successive block, recording the number of ON pixels for each block, determining a maximum number of ON pixels in a block from the recorded numbers of ON pixels, and determining the image density for the image data based on the determined maximum number of ON pixels.

7. The method of claim 1 wherein the step of selecting the printing mode comprises selecting the single pass 100% coverage printing mode when the sensed temperature is about 30° C. or below.

8. The method of claim 1 wherein the step of selecting the printing mode comprises selecting the single pass 100% coverage printing mode when the sensed temperature is about 30° or below and the density is determined to be high compared to a referrence value.

9. The method of claim 8 further comprising the step of setting a reduced printhead droplet ejection rate based on the sensed temperature and the determined density.

10. The method of claim 9 wherein the step of setting the printhead droplet ejection rate comprises setting the ejection rate to 4.5 kHz.

11. The method of claim 1 wherein the step of selecting the printing mode comprises selecting the single pass 100% coverage printing mode when the sensed temperature is about 30° or below and the density is determined to be low compared to a referrence value.

12. The method of claim 11 further comprising the step of setting a standard printhead droplet ejection rate based on the sensed temperature and the determined density.

13. The method of claim 12 wherein the step of setting the printhead droplet ejection rate comprises setting the ejection rate to 6.0 kHz.

14. The method of claim 1 wherein the step of selecting the printing mode comprises selecting the double pass checkerboard printing mode when the sensed temperature is above about 30° C.

15. The method of claim 14 further comprising the step of setting a standard printhead droplet ejection rate of 6.0 kHz.

16. The method of claim 1 wherein the step of selecting a printing mode comprises selecting the double pass checkerboard printing mode when the sensed temperature is above about 30° and the density is determined to be high compared to a referrence value.

17. The method of claim 1 wherein the step of selecting the printing mode comprises selecting the double pass checkerboard printing mode when the sensed temperature is above about 30° and the density is determined to be low compared to a referrence value.

18. A method of printing an image based on image data using an ink jet printer having a printhead comprising the steps of:

sensing an internal temperature of the printer;

determining density of the image;

automatically setting a printhead droplet ejection rate based on the sensed temperature and the determined density; and printing the image using the set ejection rate.

19. The method of claim 18 further comprising the step of storing the image data in an array of ON and OFF pixels and wherein the step of determining the density of the image includes dividing the array of pixels into groups and determining a maximum number of ON pixels in a group.

20. The method of claim 18 further comprising the step of storing the image data in an array of ON and OFF pixels and wherein the step of determining density comprises defining a window that encompasses a block of pixels in the array, positioning the window around successive blocks of pixels in the entire array, counting a number of ON pixels in each successive block, recording the number of ON pixels for each block, determining a maximum number of ON pixels in a block from the recorded numbers of ON pixels, and determining the image density for the image data based on the determined maximum number of ON pixels.

21. The method of claim 18 wherein the step of sensing the temperature of the printer includes sensing an ambient temperature near the printhead.

22. The method of claim 18 wherein the step of sensing the temperature of the printer includes sensing a temperature of a circuit board located adjacent the printhead.

23. The method of claim 18 wherein the step of setting the printhead droplet ejection rate comprises reducing the ejection rate to 4.5 kHz when the sensed temperature is about 30° C. or below and the density is determined to be high compared to a referrence value.

24. The method of claim 18 wherein the step of determining the droplet ejection rate comprises setting a standard ejection rate of 6.0 kHz when the sensed temperature is above about 30° C.

25. The method of claim 18 wherein the step of determining the droplet ejection rate comprises setting a standard ejection rate of 6.0 kHz when the density is determined to be low compared to a referrence value.

26. The method of claim 18 further comprising the step of automatically selecting one of a single pass 100% coverage printing mode and double pass checkerboard printing mode based on the sensed temperature and the determined density, and wherein the step of printing the image uses the selected printing mode.

27. The method of claim 26 wherein the step of selecting the printing mode comprises selecting the single pass 100% coverage printing mode when the sensed temperature is about 30° C. or below.

28. The method of claim 26 wherein the step of selecting the printing mode comprises selecting the single pass 100% coverage printing mode when the sensed temperature is about 30° C. or below and the density is determined to be high compared to a reference value.

29. The method of claim 28 wherein the step of setting the printhead droplet ejection rate comprises setting a reduced ejection rate of 4.5 kHz.

30. The method of claim 26 wherein the step of selecting the printing mode comprises selecting the single pass 100% coverage printing mode when the sensed temperature is about 30° or below and the density is determined to be low compared top a referrence value.

31. The method of claim 26 wherein the step of selecting the printing mode comprises selecting the double pass checkerboard printing mode when the sensed temperature is above about 30° C.

32. The method of claim 26 wherein the step of selecting the printing mode comprises selecting the double pass checkerboard printing mode when the sensed temperature is above about 30° C. and the density is determined to be high compared to a referrence value.

33. The method of claim 26 wherein the step of selecting the printing mode comprises selecting the double pass checkerboard printing mode when the sensed temperature is above about 30° and the density is determined to be low compared to a referrence value.

34. An ink jet printer having a printhead, comprising:

a memory that stores print data corresponding to an image to be printed;

a temperature sensor that senses an internal temperature of the printer adjacent the printhead;

a density determiner that determines density of the image being printed from the stored print data;

a controller coupled to the memory, the temperature sensor, and the density determiner that automatically selects one of a single pass print mode and a double pass print mode and automatically sets a printhead droplet ejection rate based on the sensed temperature and the determined density; and a printing mechanism coupled to the controller that prints the image based on the stored print data in the selected print mode and the set printhead droplet ejection rate.

35. The printer of claim 34 wherein the memory stores the print data in an array of ON and OFF pixels and the density determiner comprises a filter that filters through successive blocks of print data in the array, a counter that counts ON pixels in each filtered block, and a computing mechanism that determines a maximum number of ON pixels for a block of print data in the array.

36. The printer of claim 34 wherein the controller selects a single pass 100% coverage mode when the temperature is about 30° C. or below.

37. The printer of claim 34 wherein the controller selects a double pass checkerboard mode when the temperature is above about 30° C.

38. The printer of claim 34 wherein the controller sets a standard ejection rate of 6 kHz when the density is determined to be low compared to a referrence value.

39. The printer of claim 34 wherein the controller sets a standard ejection rate of 6 kHz when the temperature is above about 30° C.

40. The printer of claim 34 wherein the controller sets a reduced ejection rate of 4.5 kHz when the density is determined to be high compared to a referrence value and the temperature is about 30° C. or below.

* * * * *